United States Patent [19]

Franco

[11] 3,940,129

[45] Feb. 24, 1976

[54] GAME OF BALANCE

[75] Inventor: John A. Franco, Daly City, Calif.

[73] Assignee: The Raymond Lee Organization, Inc., New York, N.Y. ; a part interest

[22] Filed: Nov. 4, 1974

[21] Appl. No.: 520,280

[52] U.S. Cl. ..... 273/1 R; 273/DIG. 17
[51] Int. Cl.[2] ..... A63F 9/00; A63B 71/04
[58] Field of Search ..... 273/1 R, 1 E, 1 M, DIG. 17

[56] References Cited

UNITED STATES PATENTS 3,498,610 3/1970 Foley et al. ..... 273/1 R
3,533,622 10/1970 Foley et al. ..... 273/1 R
3,759,515 9/1973 Crooks ..... 273/1 R

*Primary Examiner*—Paul E. Shapiro
*Attorney, Agent, or Firm*—Howard I. Podell

[57] ABSTRACT

A party game for two players wearing foam rubber or plastic headbands in which each stands on his own circular disc, and tries to push his opponent out of the opponent's circle with his hands tied behind his back, by pushing his head band against his opponent's head band.

2 Claims, 5 Drawing Figures

GAME OF BALANCE

SUMMARY OF THE INVENTION

My invention relates to a party game, and particularly to a game in which two participants each wearing a foam rubber or plastic head band stand on his own circular disc, and tries to push the other out of the circle, by pushing his head band against his opponent's head band. To avoid use of hands, the hands are placed behind the back, and a tie strap secured around the wrists.

BRIEF DESCRIPTION OF THE DRAWINGS

The objects and features of the invention may be understood with reference to the following detailed description of an illustrative embodiment of the invention, taken together with the accompanying drawings in which.

Figure 1:
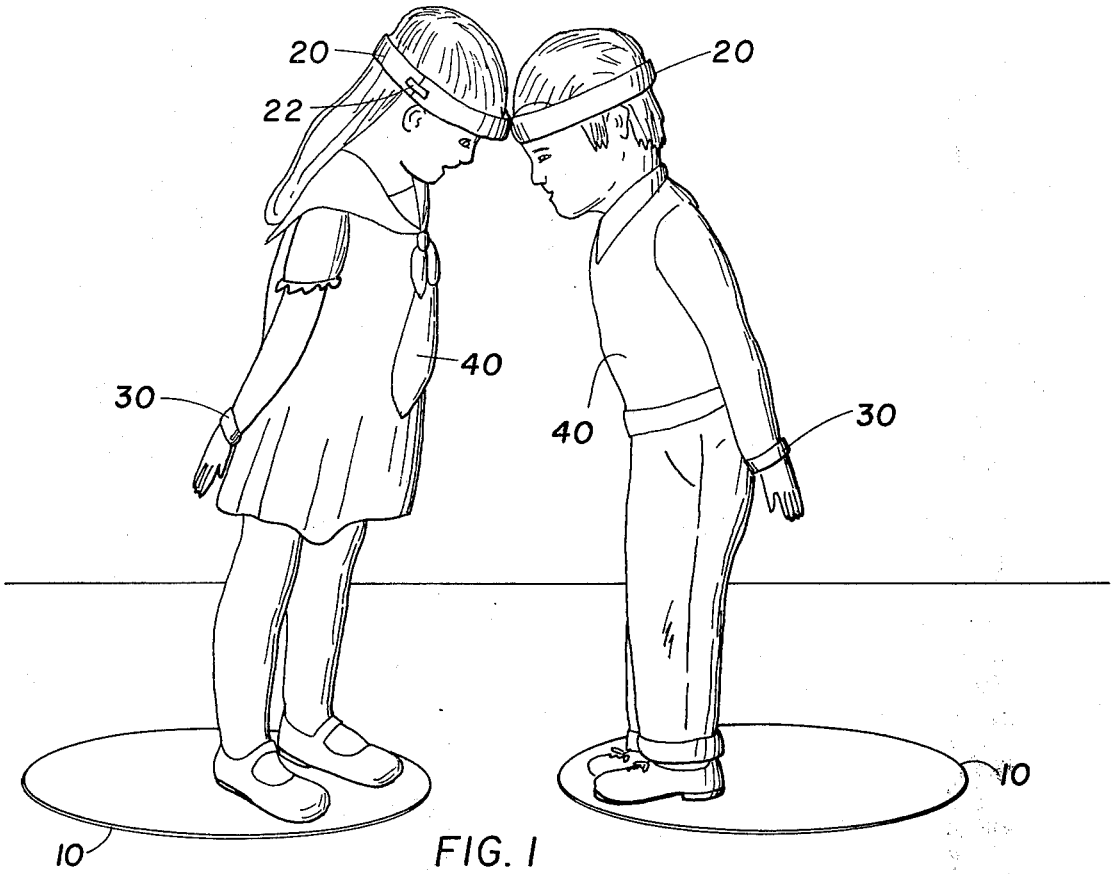
FIG. 1 is a perspective view of the game being played.

DESCRIPTION OF THE PREFERRED EMBODIMENT:

Turning now descriptively to the drawings, in which similar reference characters denote similar elements throughout the several views, FIG. 1 illustrates the two players 40 each standing on an individual circular disc 10 of about 15 inches diameter mounted adjacent each other. Each player 40 has his wrists tied behind his back by a wrist band 30 and wears a foam rubber or plastic head band 20 and attempts by pushing his head band 20 against that of his opponent to push his opponent off of his disc 10 or to otherwise cause him to lose his balance.

Figure 2:
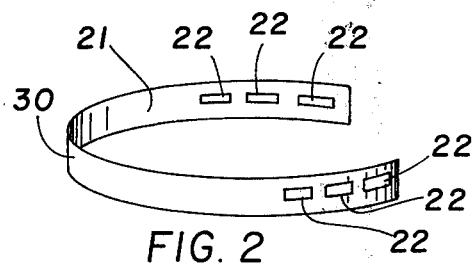
FIG. 2 is a perspective view of a wrist band.
Figure 5:
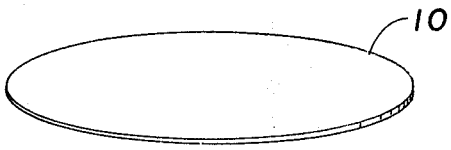
FIG. 5 is a perspective view of the circular disc.

As shown in FIG. 2, the wrist bands 30 are of flexible sheet aterial fitted with Velcro or adhesive tabs 22 to enable fastening a band 30 about a pair of wrists.

Figure 3:
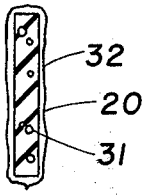
FIG. 3 is a sectional view of a head band taken along line 3—3 of FIG. 4.
Figure 4:
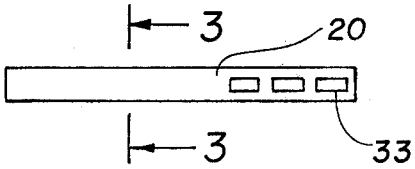
FIG. 4 is an elevation view of a head band.

As shown in FIGS. 3–4, the head band 20 is formed of a core 31 of foam rubber or plastic enclosed by flexible sheeting 32. Adhesive tabs 33 are mounted on one end of the head band for enabling the band to be fastened as a loop about the head of a player.

The disc 10, as shown in FIG. 4 may be preferably of fibre, paper board or wood.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A game device for playing a party game with two competing players comprising the following equipment:

a pair of headbands each formed of a strip of foam material enclosed by a flexible sheeting, with a fastening tab mounted externally adjacent one end of each strip for fastening to the other end of the said strip about a players head, a pair of flexible wrist bands each formed of flexible sheeting in the form of a strip and each fitted with fastening means for joining the ends of each strip together about a pair of wrists of a player, and a pair of circular discs, with both discs being of the same diameter, and with each disc being of a size to enable a player to place both feet upon a disc resting on a floor, such that each player may stand on one of the two discs, with the discs located in general proximity to each other, with the two players fitted with the headbands and with the hands of the players fastened behind their backs in the wrist bands, and each of the players may attempt to push the other player out of the area bounded by the disc upon which he is standing by pushing his headband against the headband of the opposing player.

2. The combination as recited in claim 1 in which the diameter of each disc is in the general order of 15 inches.

* * * * *